United States Patent [19]

Black et al.

[11] Patent Number: 5,032,056

[45] Date of Patent: Jul. 16, 1991

[54] FLUID COMPRESSOR

[75] Inventors: Nicholas Black; Peter J. Taylor, both of Hampshire, England

[73] Assignee: Plessey Overseas Limited, Ilford, England

[21] Appl. No.: 339,982

[22] Filed: Apr. 18, 1989

[30] Foreign Application Priority Data

Apr. 19, 1988 [GB] United Kingdom ..... 8809209

[51] Int. Cl.[5] ..... F01D 13/02

[52] U.S. Cl. ..... 415/143; 415/199.6; 417/68

[58] Field of Search ..... 415/143, 199.6; 417/68, 417/69

[56] References Cited

U.S. PATENT DOCUMENTS

| | | | |
|---|---|---|---|
| 3,228,587 | 1/1966 | Segebrecht | 417/68 |
| 4,323,334 | 4/1982 | Haavik | 417/68 |
| 4,710,105 | 12/1987 | Segebrecht | 417/68 |
| 4,747,752 | 5/1988 | Somarakis | 417/68 |
| 4,946,349 | 8/1990 | Manabe et al. | 417/68 |

*Primary Examiner*—John T. Kwon

*Attorney, Agent, or Firm*—Fleit, Jacobson, Cohn, Price, Holman & Stern

[57] ABSTRACT

A fluid compressor comprises a casing containing liquid and having located within it a shaft driven radial impeller for pressurizing the liquid before it is fed to a further rotatable structure. By rotation of the impeller and the further rotatable structure, the high pressure liquid compresses a gas or vapor within the compressor casing and expels it from the casing through an outlet port therein. The high pressure liquid inlet end of the rotatable structure is partially shrouded by a shroud structure to restrict the input of high pressure liquid to part of the rotatable structure. The shroud structure has an opening therein which allows the high pressure liquid entering the rotatable structure to be depressurized and returned to the inlet end of the radial impeller after compressing the gas or vapor. By so doing, further gas or vapor for compression will be drawn into the compressor casing.

5 Claims, 1 Drawing Sheet

FLUID COMPRESSOR

This invention relates to gas (e.g. air) and/or vapour compressors.

Known gas and/or vapour compressors comprise:

(a) Positive displacement pumps (e.g. piston or gear pumps) which have a relatively short life and produce high noise, (b) Rotary fan type compressors which operate at very high speeds giving rise to bearing and high noise problems, and (c) Liquid-ring compressors which are inefficient in power usage.

The present invention is directed to a gas and/or vapour compressor having relatively high power efficiency, long life and producing minimum noise in operation.

According to the present invention there is provided a gas and/or vapour compressor comprising a casing containing liquid and having located within it a shaft driven radial impeller for pressurising said liquid before said liquid is fed to a further rotatable structure where by rotation thereof, the high pressure liquid compresses a gas or vapour within the compressor casing and expels it from the casing through an outlet port therein. The high pressure liquid inlet end of the rotatable structure is partially shrouded by shroud means to restrict the input of high pressure liquid to part of said rotatable structure. The shroud means has an opening therein which allows the high pressure liquid entering the rotatable structure to be de-pressurised and returned to the inlet end of the radial impeller after compressing said gas and/or vapour and, by so doing, further gas and/or vapour for compression will be drawn into said compressor casing.

In carrying out the present invention, the further rotatable structure may comprise an axial impeller driven by the same shaft as the radial impeller. Alternatively, the rotatable structure may comprise a radial turbine which is arranged to be driven by the high pressure liquid discharged from the radial impeller into the radial turbine.

The high pressure liquid entering the axial impeller or radial turbine, where gas or vapour drawn into the casing through the inlet port means of the compresser is compressed, may be discharged through the opening in the shroud means referred to as a result of the centrifugal field of the axial impeller or radial turbine and may then be piped to the inlet side of the radial impeller.

By way of example, the present invention will now be decribed with reference to the accompanying drawings, in which.

Figure 1:
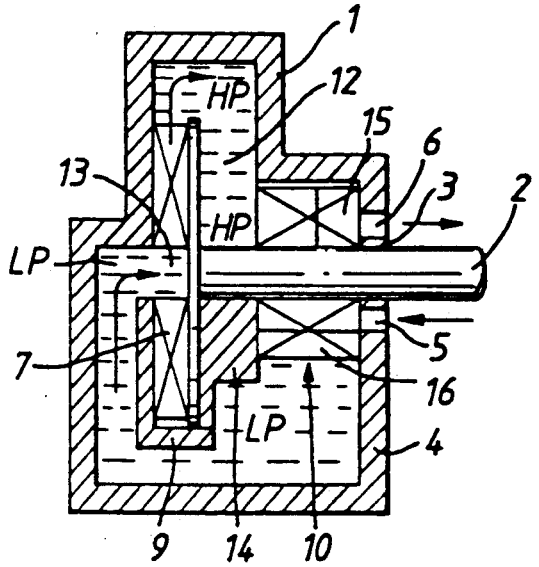
FIG. 1 shows a cross-sectional view of one embodiment of a gas and/or vapour compressor according to the present invention.
Figure 2:
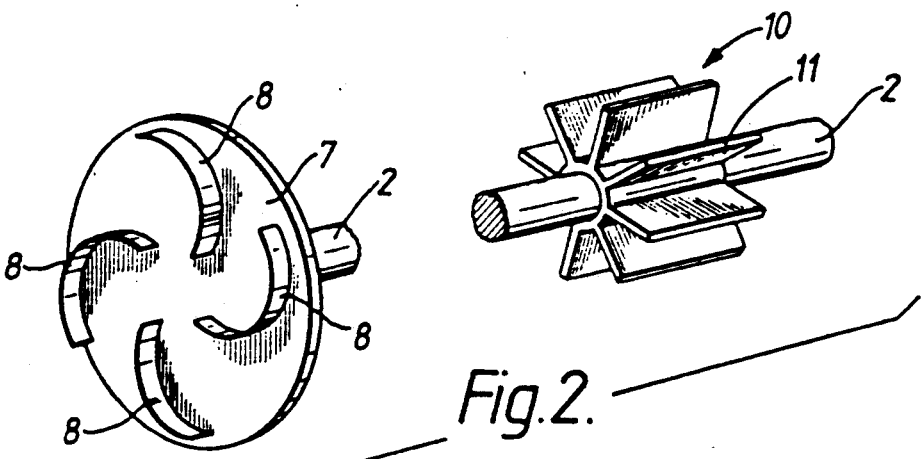
FIG. 2 shows perspective views of the impeller components of the compressor of FIG. 1.

Referring to FIGS. 1 and 2 of the drawings, the compressor illustrated comprises a generally cylindrical casing 1 having a driven shaft 2 mounted by means of a bearing arrangement 3 in an end wall 4 of the compressor casing. Gas and/or vapour inlet and outlet ports 5 and 6, respectively, are provided in the casing end wall 4 and at diametrically-opposite positions relative to the driven shaft 2. The driven shaft 2 has fixedly secured to its free end within the casing 1 a radial or centrifugal impeller 7, shown in perspective in FIG. 2 having curved vanes 8 and located within a volute wall 9 of the casing. The driven shaft 2 also has secured to it an axial impeller 10 having vanes 11 which is also shown in perspective FIG. 2.

The compressor casing contains liquid 12. In operation of the compressor, in response to rotation of the driven shaft 2, which may be driven by an electric motor (not shown), low pressure liquid at location LP which extends to the inlet side 13 of the radial centrifugal impeller 7 will be pressurised by the impeller 7 to produce high pressure liquid at location HP. The high pressure liquid discharged by the radial impeller 7 into the axial impeller 10 will accordingly be pumped in the axial direction and, by reason of the fact that the inlet end of the axial impeller is half shrouded by means of a shroud struture 14, the air and/or gas at location 15 within the compressor casing will be compressed by the axial feed of the impeller 10 and forced out of the compressor outlet port 6. The air and/or vapour within the casing at 15 will be compressed to a level equivalent to the discharge pressure of the liquid in the radial impeller plus the discharge pressure of the axial impeller. At the same time, air or gas will be drawn into the casing 1 through the inlet port 5 as the high pressure liquid is urged by the centrifugal field of the axial impeller 10 into a slot 16 in the shroud 14 and will then be piped as shown to the inlet side of the centrifugal impeller 7.

Figure 3:
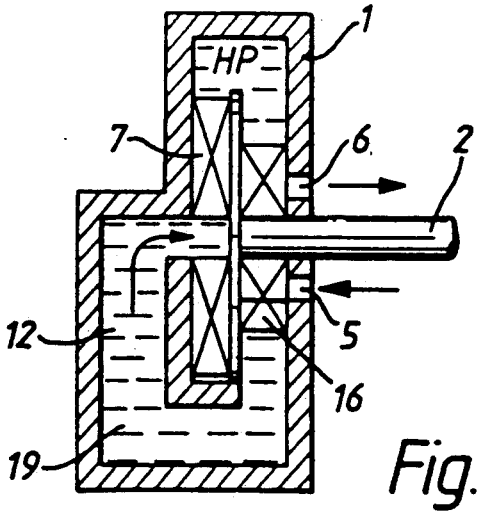
FIG. 3 shows an alternative embodiment of the present invention.
Figure 4:
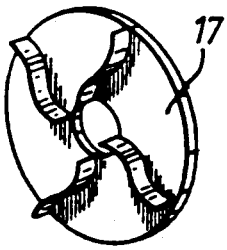
FIG. 4 shows a perspective view of the turbine component of the compressor of FIG. 3.

Referring now to FIGS. 3 and 4 of the drawings, these show an alternative construction of compressor in which the axial impeller fixed to the shaft 2 of the FIG. 1 construction is replaced by a radial turbine 17 which is free to rotate on the driven shaft 2. In this case, the turbine 17 is itself driven by the high pressure liquid at the location HP. As the turbine 17 is rotated, air or vapour drawn into the compressor through inlet port 5 is compressed and expelled or discharged through the outlet port 6, and the liquid is returned to the inlet side of the radial impeller of the compressor by means of a pipe 19.

We claim:

1. A fluid compressor comprising:

a casing containing liquid and having located within it a shaft driven radial impeller for pressurising the liquid, and a further rotatable structure within the casing for receiving high pressure liquid from the impeller and which, by rotation thereof, in conjunction with the high pressure liquid, compresses a gas or vapour within the compressor casing and expels it from the casing through an outlet port therein, the further rotatable structure having a high pressure liquid inlet end which is partially shrouded by shroud means to restrict the input of high pressure liquid to part of said further rotatable structure and said shroud means having an opening therein which allows the high pressure liquid entering the further rotatable structure to be de-pressurised and returned to an inlet end of the radial impeller after compressing said gas or vapour and thereby further recirculating gas or vapour into said compressor casing.

2. A fluid compressor as claimed in claim 1, in which the further rotatable structure comprises a radial turbine which is arranged to be driven by the high pressure liquid discharged from the radial impeller into the radial turbine.

3. A fluid compressor comprising:

a casing containing liquid and having located within it a shaft driven radial impeller for pressurising the liquid, and a further rotatable structure within the casing for receiving high pressure liquid from the impeller and which, by rotation thereof, in conjunction with the high pressure liquid, compresses a gas or vapour within the compressor casing and expels it from the casing through an outlet port therein, the further rotatable structure comprising an axial impeller driven by the same shaft as the radial impeller and having a high pressure liquid inlet end which is partially shrouded by shroud means to restrict the input of high pressure liquid to part of said further rotatable structure and said shroud means having an opening therein which allows the high pressure liquid entering the further rotatable structure to be de-pressurised and returned to an inlet end of the radial impeller after compressing said gas or vapour and thereby further recirculating gas or vapour into said compressor casing.

4. A fluid compressor as claimed in claim 3, in which the high pressure liquid entering the axial impeller or radial turbine where gas or vapour drawn into the casing through the inlet part means of the compressor is compressed is discharged through the opening in the shroud means as a result of the centrifugal field of the further rotatable structure.

5. A fluid compressor as claimed in claim 4, in which the gas or vapour discharged through the opening in the shroud means is piped to the inlet side of the radial impeller.

* * * * *